US008083388B2

(12) United States Patent
Sun et al.

(10) Patent No.: US 8,083,388 B2
(45) Date of Patent: Dec. 27, 2011

(54) AUTOMOBILE LAMP

(75) Inventors: Ching-cherng Sun, Jhongli (TW); Chih-ming Hu, Jhongli (TW)

(73) Assignee: National Central University, Taoyuan (TW)

( * ) Notice: Subject to any disclaimer, the term of this patent is extended or adjusted under 35 U.S.C. 154(b) by 395 days.

(21) Appl. No.: 12/360,229

(22) Filed: Jan. 27, 2009

(65) Prior Publication Data

US 2010/0165649 A1 Jul. 1, 2010

(51) Int. Cl.
*F21V 9/00* (2006.01)

(52) U.S. Cl. ..... 362/511; 352/522

(58) Field of Classification Search ..... 362/521–522, 362/510–511, 555
See application file for complete search history.

(56) References Cited

U.S. PATENT DOCUMENTS 4,796,171 A * 1/1989 Lindae et al. ..... 362/308
5,678,916 A * 10/1997 Watanabe et al. ..... 362/465
2006/0083013 A1 * 4/2006 Wanninger et al. ..... 362/509

* cited by examiner

*Primary Examiner* — Julie Shallenberger
(74) *Attorney, Agent, or Firm* — Chun-Ming Shih

(57) ABSTRACT

An automobile lamp includes a light emitting element used as an initial light source, a light guide element for calculating a divergence angle and a light emitting area of the divergence angle of the initial light source, and a lens element to enhance a light extraction efficiency of the light emitting element and produce a light source with a predetermined light pattern and a high light extraction efficiency. A projecting element is used for enhancing the contrast of the light pattern of the light source, so that the automobile lamp can project a high-contrast cutoff line. A light emitting surface of the light emitting element is designed with a predetermined shape, such that no other optical component is required for projecting a light beam with a cross-section of a predetermined shape, so as to enhance a light energy utilization efficiency of the automobile lamp effectively.

6 Claims, 3 Drawing Sheets

AUTOMOBILE LAMP

FIELD OF THE INVENTION

The present invention relates to an automobile lamp, and more particularly to an automobile lamp using a light emitting element, a light guide element and a lens element to generate a light source with a predetermined light pattern and a high light extraction efficiency, and using a projecting element to enhance the contrast of a light pattern of the light source for projecting a high-contrast cutoff line.

BACKGROUND OF THE INVENTION

Automobile lamp provides illuminations for pedestrians to determine traveling directions of motor vehicles and motorcycles to avoid car accidents, and illuminations for drivers to maintain traffic safety in different road conditions.

As the level of our health care rises, the age of drivers becomes increasingly higher. Compared with young people, elder ones have a lower vision capability. To compensate a deteriorated vision and a slow response, it is necessary to increase the illumination contrast for the automobile lamp and set a higher specification of the automobile lamp to provide better illuminations in order to improve the safety of driving, particularly for a high speed of cars on highways.

In the current trend of social development, increasing the illumination contrast of automobile lamps is an urgent issue that demands immediate attentions and feasible solutions. However, a traditional automobile lamp generally installs a light emitting element (such as a tungsten filament lamp and a halogen lamp, etc) at the position of the focus of a reflective lens, and uses the reflective lens to focus a light emitted from the light emitting element, such that the light can be projected in a direction parallel to a projecting lens to produce a light beam with a cross-section in a predetermined shape.

In the design of the traditional automobile lamp, a piece of mask in a specific shape can be installed at the focal point of the reflective lens, so that the light emitted from the light emitting element is masked by the mask, and only a portion of the light is projected in a direction parallel to the projecting lens to produce a light beam with a cross-section in a compliant shape. However, the overall light energy utilization efficiency will be lowered due to the factor of the mask.

It is an object of the invention to develop a new technology to enhance the illumination contrast for an automobile lamp and project a light beam with a cross-section in a shape in compliance with related laws and regulations without requiring the mask, so as to overcome the aforementioned shortcomings of the traditional automobile lamp, and achieve the effects of compensating the deteriorate vision and slow response and improving the safety of driving.

SUMMARY OF THE INVENTION

Therefore, it is a primary objective of the present invention to provide an automobile lamp that uses a light source module to generate a light source with a predetermined light pattern and a high light extraction efficiency, and then uses a projecting element to receive the light source, such that a high-contrast cutoff line is projected after the contrast of the light pattern of the light source is enhanced to achieve the effect of projecting a light beam with a cross-section in compliance with related laws and regulations without need of the mask and having a high illumination contrast for compensating the deteriorated vision and the slow response and enhancing the safety of driving.

Another objective of the present invention is to provide an automobile lamp, wherein a light source module of the automobile lamp comprises a light emitting element, a light guide element and a lens element, and the light emitting element is provided for projecting a light beam with a cross-section in a predetermined shape and using the light beam as an initial light source, and the light guide element is provided for converging a divergence angle of the initial light source, and the lens element is provided for improving a light extraction efficiency of the light emitting element, so that the light source module can generate a light source with a predetermined light pattern and a high light extraction efficiency.

DETAILED DESCRIPTION OF THE PREFERRED EMBODIMENTS

To make it easier for our examiner to understand the technical measures and the operating procedure of the present invention, we use preferred embodiments together with the attached drawing for the detailed description of the present invention.

Figure 1:
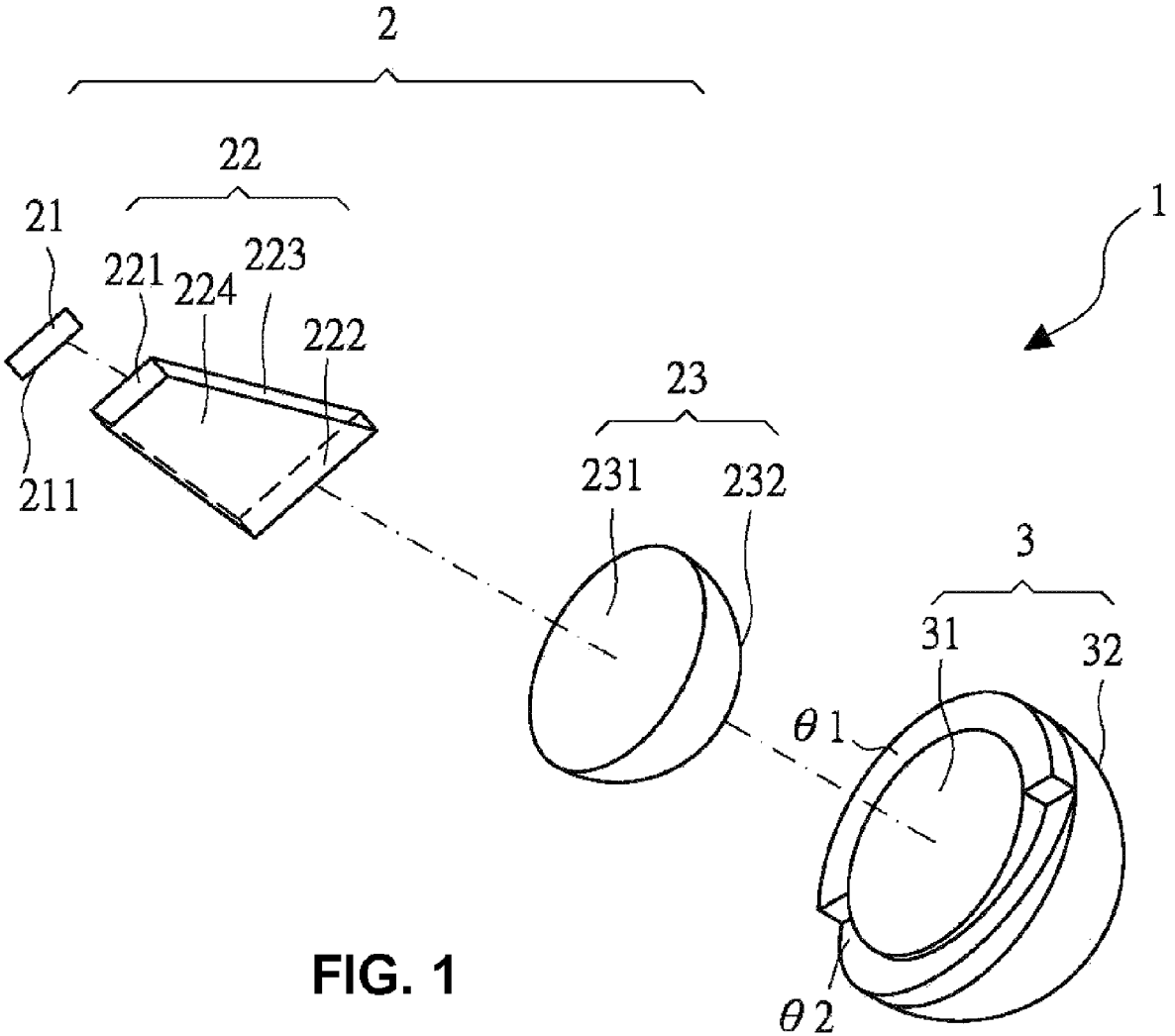
FIG. 1 is a side view of a structure in accordance with the present invention.

With reference to FIG. 1 for an automobile lamp of the present invention, the automobile lamp 1 comprises a light source module 2 and a projecting element 3, wherein the light source module 2 is provided for generating a light source with a predetermined light pattern and a high light extraction efficiency; and the projecting element 3 includes a light incident surface 31 and a light emitting surface 32, and the light incident surface 31 is coupled to a light emitting surface 232 of the light source module 2 for receiving the light source, and after the contrast of a light pattern of the light source is enhanced, a high-contrast cutoff line is projected from the light emitting surface 232.

In the present invention, the light source module 2 comprises a light emitting element 21, a light guide element 22 and a lens element 23, and the light emitting element 21 includes a light emitting surface 211 with a predetermined shape, for projecting a light beam with a cross-section in a predetermined shape and using the light beam as an initial light source, and the light emitting element 21 is composed of a plurality of multi-chips coated with phosphor.

The light guide element 22 is a composite parabolic collector, having a light incident surface 211 and a light emitting surface 222, and the light incident surface 211 of the light guide element 22 is coupled to a light emitting surface 211 of the light emitting element 21 for receiving the initial light source to compute a divergence angle and a light emitting area of the divergence angle of the initial light source, so as to converge the divergence angle of the initial light source. If the light guide element 22 is a rectangular light pipe, the light pipe converges the divergence angle of the initial light source in a total reflection along a long side direction 223 of the light pipe by means of the design of a composite parabolic collector, after the initial light source is received, so as to improve the light energy utilization efficiency of the automobile lamp 1 and transmit the initial light source along any lateral direction 224 of the light pipe by means of the concept of parallel plates after the total reflection takes place, such that a light emitting surface of the initial light source passing through a two-dimensional plane of the light pipe in any lateral direction 224 is maintained in a square shape.

The lens element 23 is a hemispherical lens, having a light incident surface 231 and the light emitting surface 232, and the light incident surface 231 is coupled to a light emitting surface 222 of the light guide element 22 for improving the light extraction efficiency of the light emitting element 21.

In the present invention, the projecting element 3 is a specially cut aspherical lens having at least one specific angle (such as θ1 and θ2 as shown in FIG. 1) with respect to a surface of the aspherical lens, and determined by the distance of a lens axis of the aspherical lens, such that when the light source generated by the light source module 2 passes through the projecting element 3, a stray light so produced can be shifted downward, so as to enhance the contrast of the light pattern of the projecting element 3. In addition, a surface of the aspherical lens is designed as a spherical surface with a smaller curvature or a slightly protruding aspherical surface as needed to enhance the effect of adjusting the output of the light pattern and the contrast of the light pattern of the projecting element 3.

The automobile lamp 1 produced by the aforementioned components has a contrast of light pattern of over 20 and an optical system efficiency of 60%.

Figure 2:
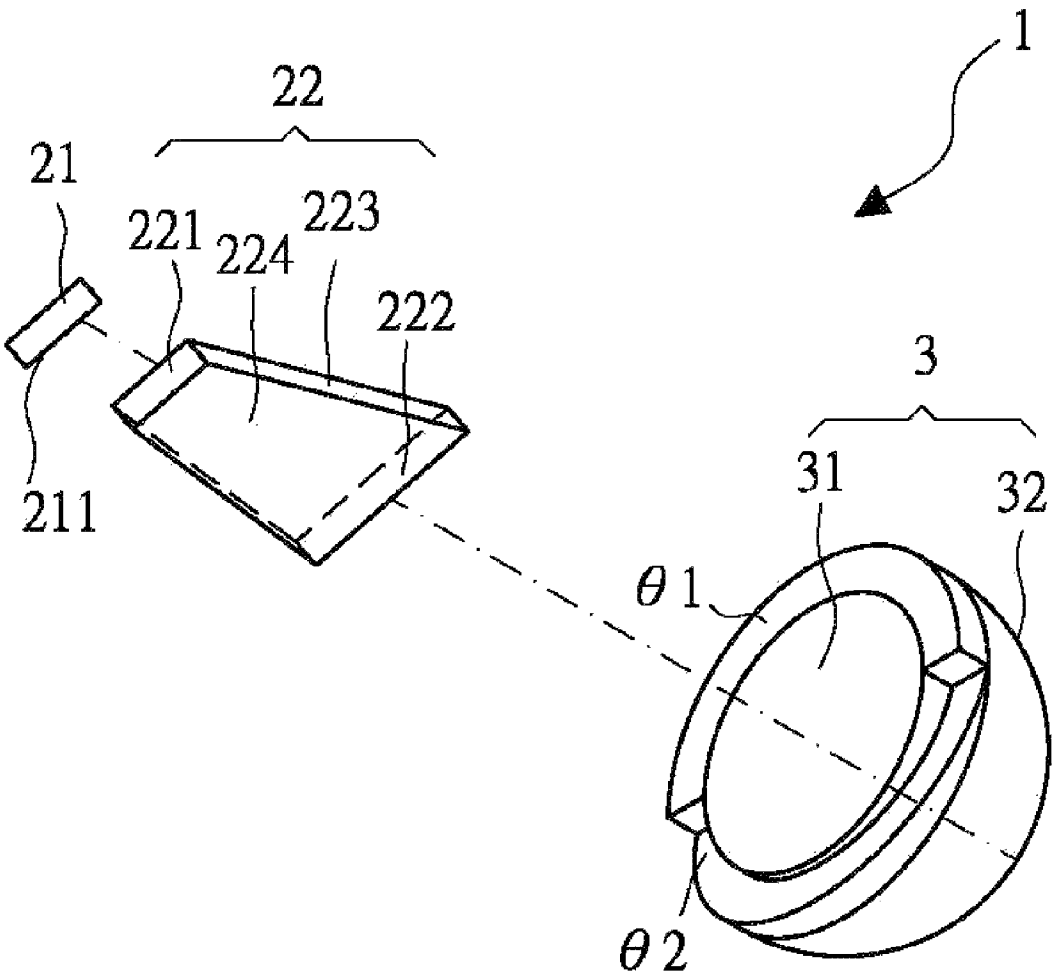
FIG. 2 is a side view of a structure of another model of light source module in accordance with the present invention.

With reference to FIG. 2 for another model of the light source module 4, this light source module 4 comprises a light emitting element 21 and a light guide element 22, wherein the light emitting element 21 has a light emitting surface 211 designed in a predetermined shape for projecting a light beam with a cross-section in a predetermined shape, and using the light beam as an initial light source, and the light emitting element 21 is composed of a plurality of multi-chips coated with phosphor.

The light guide element 22 is a composite parabolic collector having a light incident surface 221 and a light emitting surface 222, and the light incident surface 221 is coupled to a light emitting surface 211 of the light emitting element 21 for calculating a divergence angle and a light emitting area of the divergence angle of the initial light source after the initial light source is received, and converging the divergence angle of the initial light source. If the light guide element 22 is a rectangular light pipe, and after the light pipe has received the initial light source, the divergence angle of the initial light source is converged in a long side direction 223 of the light pipe by a total reflection by means of the design of a composite parabolic collector, so as to improve a light energy utilization efficiency of the automobile lamp 1, and the initial light source is transmitted in any lateral direction 224 of the light pipe by means of a concept of parallel plates, after the total reflection takes place, such that the light emitting surface of the initial light source passing through a two-dimensional plane of the light pipe in any lateral direction 224 is maintained in a square shape.

With the aforementioned components, if a light emitting surface 222 of the light source module 4 is coupled to the light incident surface 31 of the projecting element 3, the automobile lamp 1 will have a contrast of light pattern of over 20 and an optical system efficiency of 50%.

Figure 3:
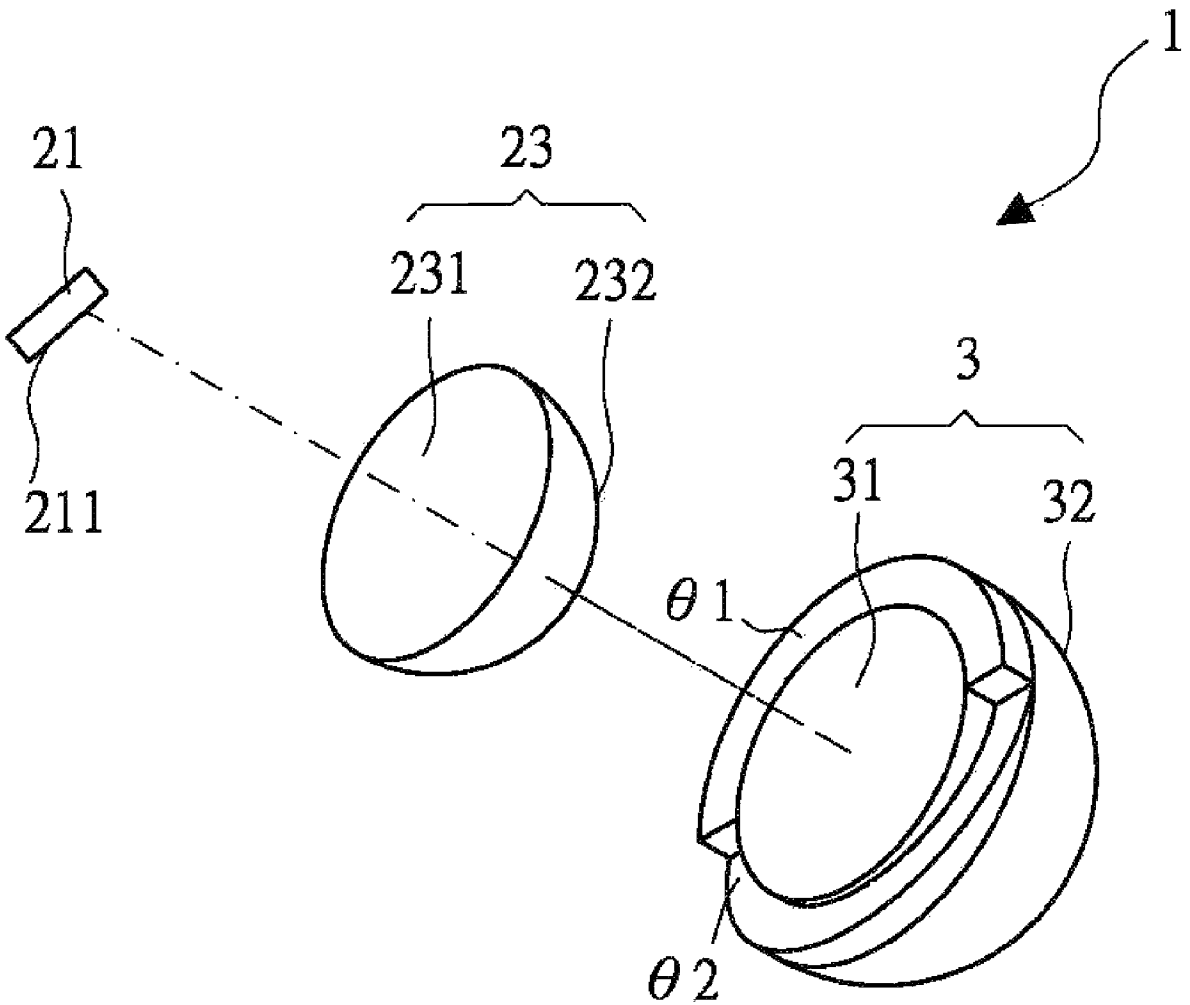
FIG. 3 is a side view of a structure of a further model of light source module in accordance with the present invention.

With reference to FIG. 3 for a further model of the light source module 5, this light source module 5 comprises a light emitting element 21 and a lens element 23, wherein the light emitting element 21 has a light emitting surface 211 designed in a predetermined shape for projecting a light beam with a cross-section in a predetermined shape and using the light beam as an initial light source, and the light emitting element 21 is composed of a plurality of multi-chips coated with phosphor.

The lens element 23 is a hemispherical lens having a light incident surface 231 and a light emitting surface 232, and the light incident surface 231 is coupled to the light emitting surface 211 of the light emitting element 21 for improving a light extraction efficiency of the light emitting element 21.

With the aforementioned components, if the light emitting surface 232 of the light source module 5 is coupled to the light incident surface 31 of the projecting element 3, the automobile lamp 1 has a contrast of light pattern of over 24.

In summation of the description above, the automobile lamp 1 of the invention has the following advantages:

1. The automobile lamp 1 has a high illumination contrast for compensating the deteriorated vision and slow response of the elderly and improving the safety of the driving.

2. The automobile lamp 1 projects a light beam having a cross-section in a shape in compliance with related laws and regulations without requiring the mask and improving the overall light energy utilization efficiency.

3. The light emitting surface 211 of the light emitting element 21 can be designed with a predetermined shape, and thus no other optical component is required for the light emitting element 21 to project a light beam with a cross-section in a predetermined shape and improve the light energy utilization efficiency effectively. In addition, the light guide element 22 with the design of the composite parabolic collector and the lens element 23 with the design of the hemispherical lens improve the illumination contrast of the automobile lamp 1 effectively.

What is claimed is:

1. An automobile lamp, comprising: a light source module including: a light emitting element, having a light emitting surface in a square shape, for projecting a light beam with a cross-section in a square shape, and using the light beam as an initial light source; a light guide element, having a light incident surface and a light emitting surface, and the light incident surface being coupled to a light emitting surface of the light emitting element for receiving the initial light source, and then converging a divergence angle of the initial light source to generate a light source with a predetermined light pattern according to a divergence angle and a light emitting area of the divergence angle of the initial light source, wherein the light guide element is a rectangular light pipe which converges the divergence angle of the initial light source in a total reflection along a long side direction of the light pipe, and transmits the initial light source beams along one lateral direction of the light pipe, such that a light emitting surface of the initial light source passing through a two-dimensional plane of the light pipe in the lateral direction is maintained in a square shape; and a lens element disposed between the light guide element and the projecting element, having a light incident surface and a light emitting surface, and the light incident surface of the lens element being coupled to a light emitting surface of the light guide element, and the light emitting surface of the lens element being coupled to a light incident surface of a projecting element; and the projecting element, having a light incident surface and a light emitting surface coupled to a light emitting surface of the light guide element, for receiving the light source, such that after the contrast of the light pattern is enhanced, a high-contrast cutoff line is projected out from the light emitting surface, wherein the projecting element is an aspherical lens with at least one specific angle cut at a surface of the aspherical lens and determined by the distance of a lens axis of the aspherical lens.

2. The automobile lamp of claim 1, wherein the light emitting element is composed of a plurality of multi-chips coated with phosphor.

3. The automobile lamp of claim 1, wherein the light guide element comes with a design of a composite parabolic collector.

4. The automobile lamp of claim 1, wherein the lens element is a hemispherical lens.

5. The automobile lamp of claim 1, wherein the specific angle cut by the projecting element falls within a range, such that a stray light caused by the light source having the predetermined light pattern and passing through the projecting element can be shifted downward.

6. The automobile lamp of claim 5, wherein the projecting element has a surface designed as a spherical surface with a small curvature or a slightly protruding aspherical surface.

* * * * *